US007587907B2

(12) United States Patent
Kim et al.

(10) Patent No.: US 7,587,907 B2
(45) Date of Patent: Sep. 15, 2009

(54) REFRIGERATOR HAVING BASKET LIFT DEVICE

(75) Inventors: Sang Oh Kim, Seoul (KR); Seung hwan Oh, Gyeonggi-Do (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 671 days.

(21) Appl. No.: 11/260,154

(22) Filed: Oct. 28, 2005

(65) Prior Publication Data

US 2006/0104756 A1 May 18, 2006

(30) Foreign Application Priority Data

Nov. 12, 2004 (KR) ..... 10-2004-0092651
Nov. 12, 2004 (KR) ..... 10-2004-0092652
Nov. 12, 2004 (KR) ..... 10-2004-0092653
Nov. 12, 2004 (KR) ..... 10-2004-0092654
Nov. 12, 2004 (KR) ..... 10-2004-0092656

(51) Int. Cl.
*F25D 17/04* (2006.01)

(52) U.S. Cl. ..... 62/186; 62/441

(58) Field of Classification Search ..... 62/186, 62/441, 448, 348, 132
See application file for complete search history.

(56) References Cited

U.S. PATENT DOCUMENTS 2,926,507 A * 3/1960 Ingolia ..... 62/377

FOREIGN PATENT DOCUMENTS

| | | |
|---|---|---|
| CN | 2185872 Y | 12/1994 |
| JP | 4-359781 A | 12/1992 |
| JP | 5-296647 | 11/1993 |

* cited by examiner

*Primary Examiner*—Melvin Jones
(74) *Attorney, Agent, or Firm*—Birch, Stewart, Kolasch & Birch, LLP

(57) ABSTRACT

A refrigerator having a basket lift device includes a main body having a refrigerating chamber; a basket received in the refrigerating chamber; a driving motor for lifting/lowering the basket; and a control unit for controlling the driving motor based on a motion of a rotational shaft of the driving motor.

37 Claims, 10 Drawing Sheets

REFRIGERATOR HAVING BASKET LIFT DEVICE

BACKGROUND OF THE INVENTION

1. Field of the Invention

The present invention relates to a refrigerator and, more particularly, to a refrigerator having a basket lift device.

2. Description of the Related Art

FIG. 1 is a perspective view of a refrigerator in accordance with a related art and FIG. 2 is a sectional view of a lower region of the refrigerator showing a state that a basket is received in a main body.

A related art refrigerator includes a main body 102 having a front side opened and a receiving space, an upper refrigerating chamber 106 disposed at an upper portion of the main body 102, having a pair of upper doors 104 opened/closed in both directions and keeping refrigerated food items, and a lower refrigerating chamber 112 disposed at a lower portion of the main body 102, partitioned from the upper refrigerating chamber 106 by a barrier wall 108 and having a lower door 110 slidably opened.

A mechanic chamber 116 having a compressor 114 for generating cooling air supplied to the upper refrigerating chamber 106 and the lower refrigerating chamber 112, or the like, is installed at a rear side of the main body 102.

A basket 120 in which food items are received is slidably disposed in an inward/outward direction, and the lower door 110 is fixed at a front side of the basket 120. When the lower door 110 is pulled out, the basket 120 is opened, and when the lower door 110 is pushed in, the basket 120 is closed. In this case, a guide rail 124 is installed between the basket 120 and an inner surface of the lower refrigerating chamber 112 to guide the basket 120 to be slidably moved in the inward/outward direction.

One or more drawers 126 for keeping food items are provided at an upper side of the basket 120 and opened slidably.

The related art refrigerator is constructed such that when the lower door 110 is pulled in the outward direction in order to take out a food item stored in the lower refrigerating chamber 112 in order to put a food item in the lower refrigerating chamber 112, the basket 120 is slidably moved to be opened. After the food item is taken out of the basket 120 or the food item is put in the basket 120, when the lower door 110 is pushed in the inward direction, the basket 120 is slidably closed.

However, the related art refrigerator has the following problem. That is, is because the installation position of the basket is too low, a user must lower his/her posture, that is, for example, the user must bend his/her back or crouch down in order to put in or take out a food item from the basket, causing users' inconvenience.

BRIEF DESCRIPTION OF THE INVENTION

Therefore, an object of the present invention is to provide a refrigerating having a basket lift device capable of enhancing user convenience in putting a food item in a basket and/or taking a food item out of the basket by lifting a position of the basket in such a manner that when the basket disposed at a lower portion of a main body of the refrigerator is opened, it is lifted upwardly.

To achieve these and other advantages and in accordance with the purpose of the present invention, as embodied and broadly described herein, there is provided a refrigerator having a basket lift device including: a main body having a refrigerating chamber; a basket received in the refrigerating chamber; a driving motor for lifting/lowering the basket; and a control unit for controlling the driving motor based on a motion of a rotational shaft of the driving motor.

To achieve the above object, there is also provided a refrigerator having a basket lift device including: a main body having a refrigerating chamber; an upper refrigerating chamber disposed at an upper portion of the main body and having an upper door; a lower refrigerating chamber divided by a barrier wall from the upper refrigerating chamber, disposed at a lower portion of the main body and having a door opened in an inward/outward direction; a basket disposed to be slid in the inward/outward direction in the lower refrigerating chamber; a driving motor for lifting/lowering the basket; and a control unit for controlling the driving motor based on a motion of a rotational shaft of the driving motor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A refrigerating having a basket lift device capable of enhancing user convenience in putting a food item in a basket and/or taking a food item out of the basket by lifting a position of the basket in such a manner that when the basket disposed at a lower portion of a main body of the refrigerator is opened, it is lifted upwardly, in accordance with the present invention will now be described with reference to FIGS. 3 to 10.

Figure 1:
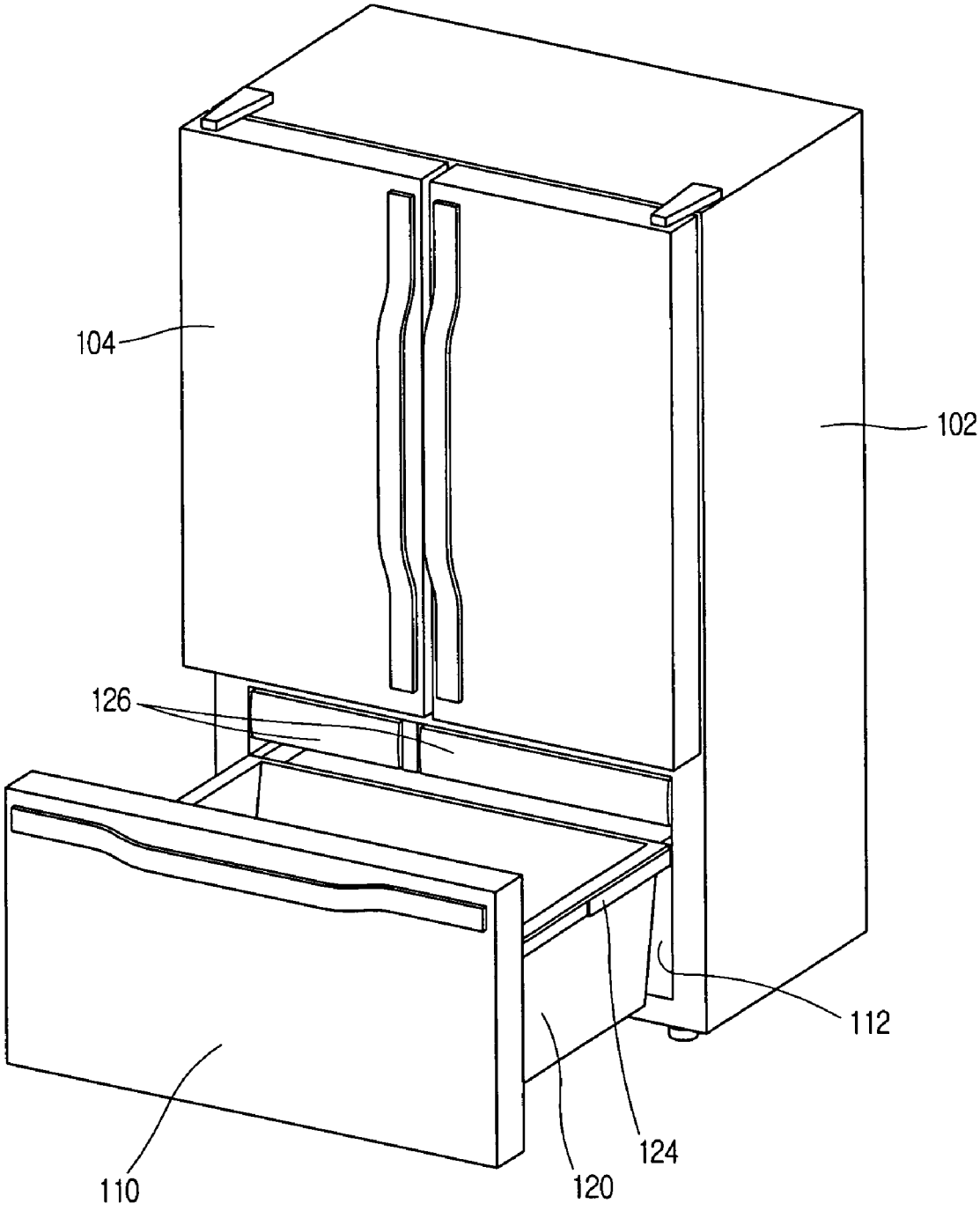
FIG. 1 CONVENTIONAL ART
FIG. 1 is a perspective view of a refrigerator in accordance with the related art.
Figure 2:
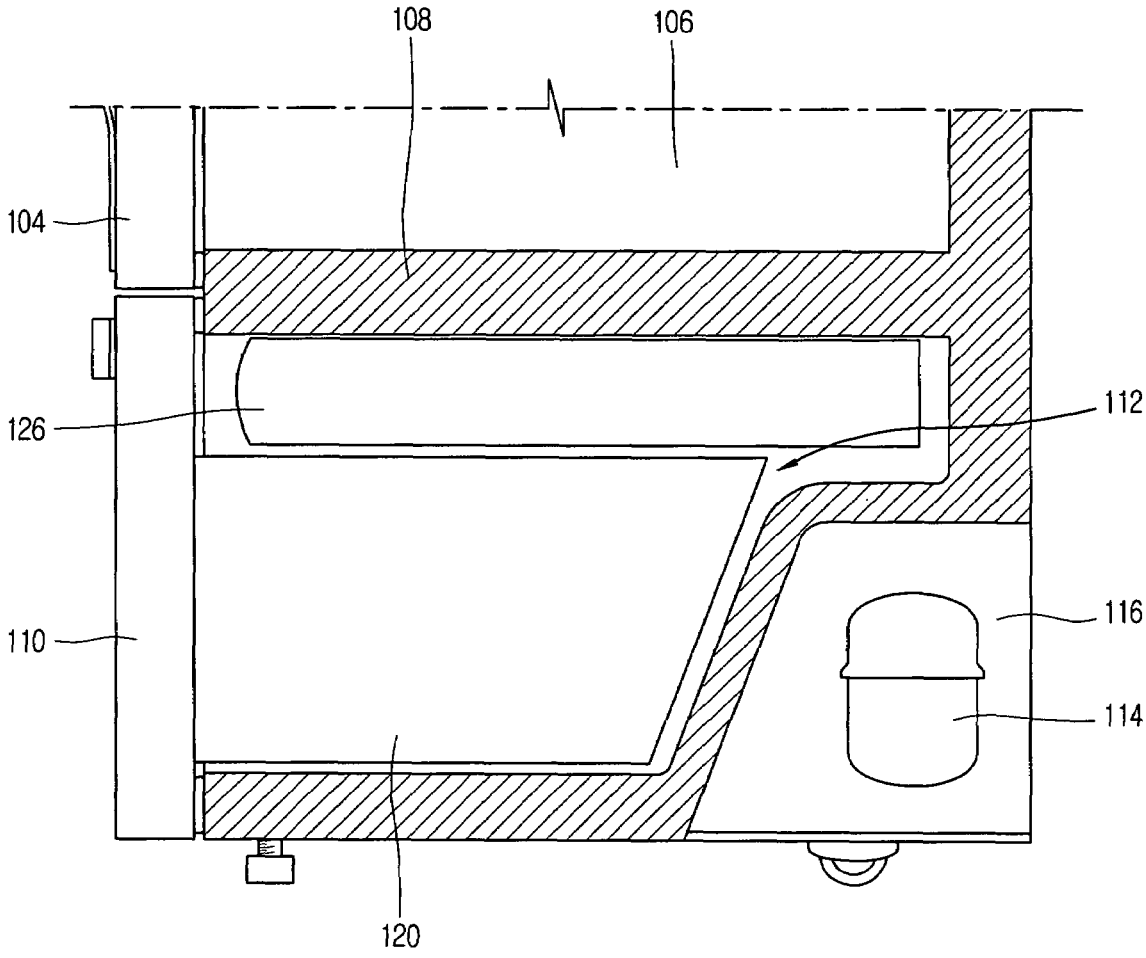
FIG. 2 CONVENTIONAL ART
FIG. 2 is a lower sectional view of the refrigerator in accordance with the related art.
Figure 3:
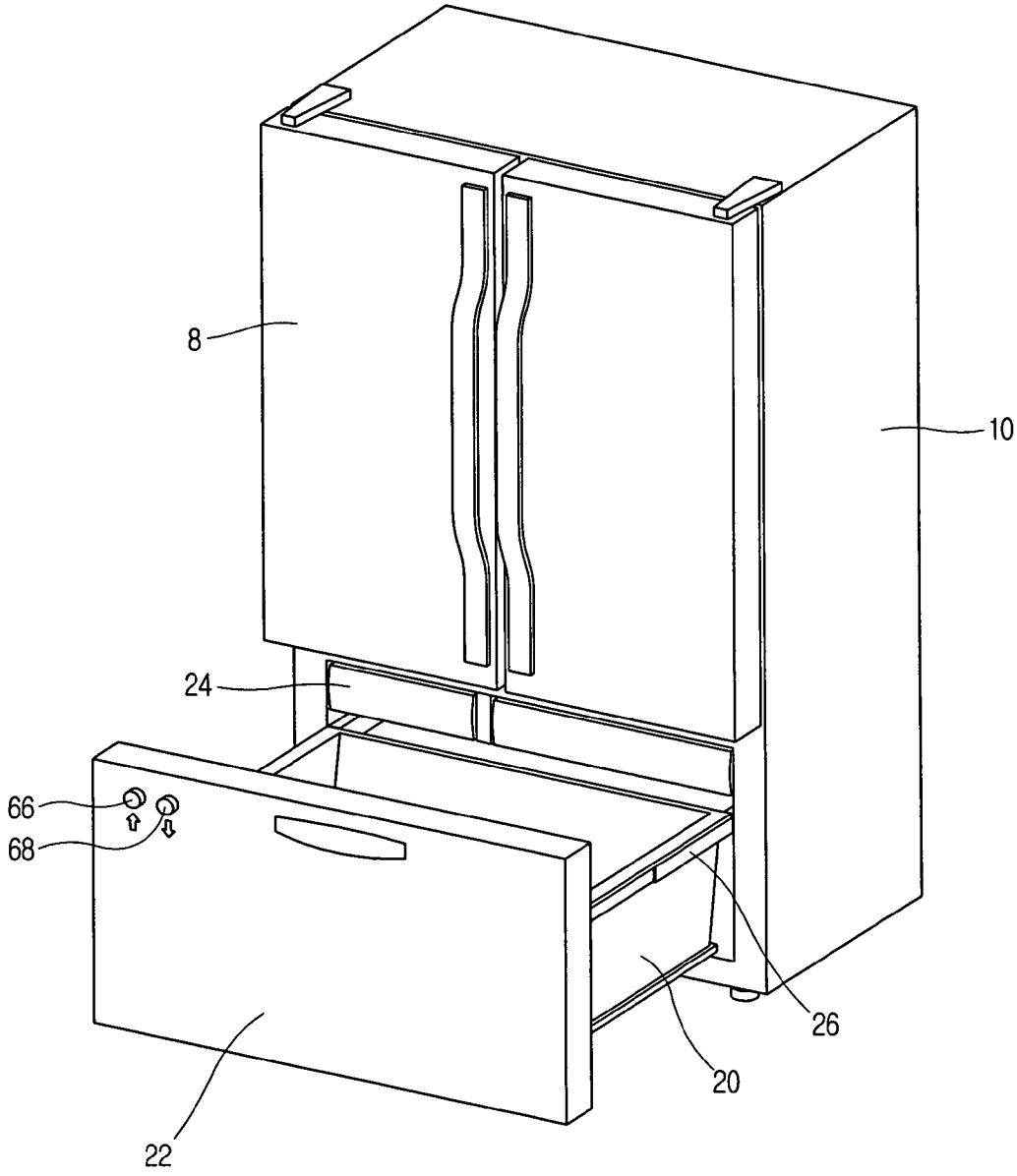
FIG. 3 is a perspective view of a refrigerator in accordance with the present invention.
Figure 4:
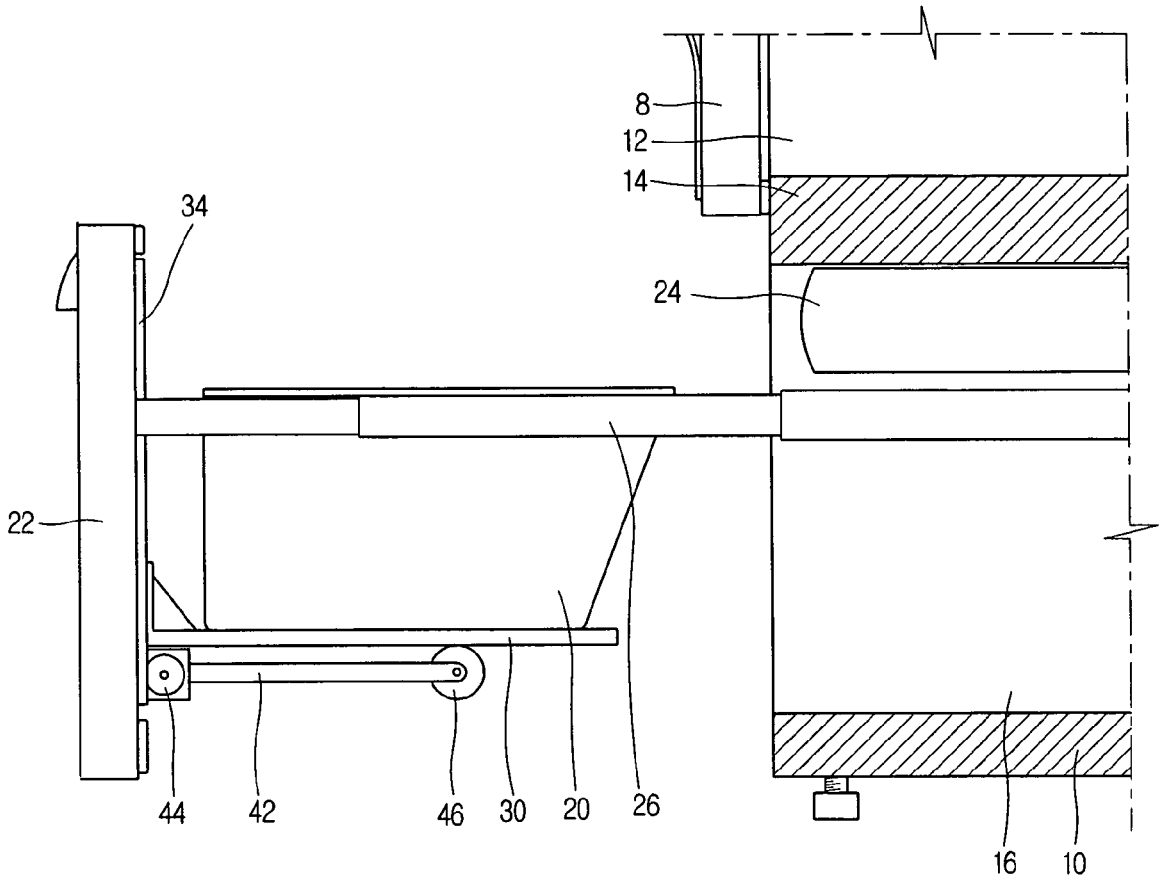
FIG. 4 is a sectional view showing a basket lift device of the refrigerator in accordance with the present invention.

FIG. 3 is a perspective view of a refrigerator in accordance with the present invention and FIG. 4 is a sectional view showing a basket lift device of the refrigerator in accordance with the present invention.

As shown in FIGS. 3 and 4, the refrigerator includes a main body 10 having a receiving space, an upper refrigerating chamber 12 disposed at an upper portion of the main body 10 and having a pair of upper doors 8 opened in both directions; a lower refrigerating chamber 16 divided by a barrier wall 14 from the upper refrigerating chamber 12 and disposed at a lower portion of the main body 10, a basket 20 disposed to be slid in an inward/outward direction at the lower refrigerating chamber 16 and keeping a food item, and a lift device for lifting/lowering the basket 20 in an upward direction.

Herein, preferably, the upper refrigerating chamber 12 is used as a refrigerating chamber for keeping refrigerated food items, while the lower refrigerating chamber 16 is used as a freezing chamber for keeping frozen food items.

A lower door 22 is disposed at a front side of the lower refrigerating chamber 16 to push in or pull out the basket 20 while moving in the inward/outward direction of the main body 10. One or more drawers 24 in which food items are stored are disposed at an upper side of the lower refrigerating chamber 16 and are drawn in the inward/outward direction.

A pair of guide rails 26 are installed between both side surfaces of the lower refrigerating chamber 16 and a rear surface of the lower door 22 to guide the lower door 22 to be slid in the inward/outward direction of the main body 10.

Figure 5:
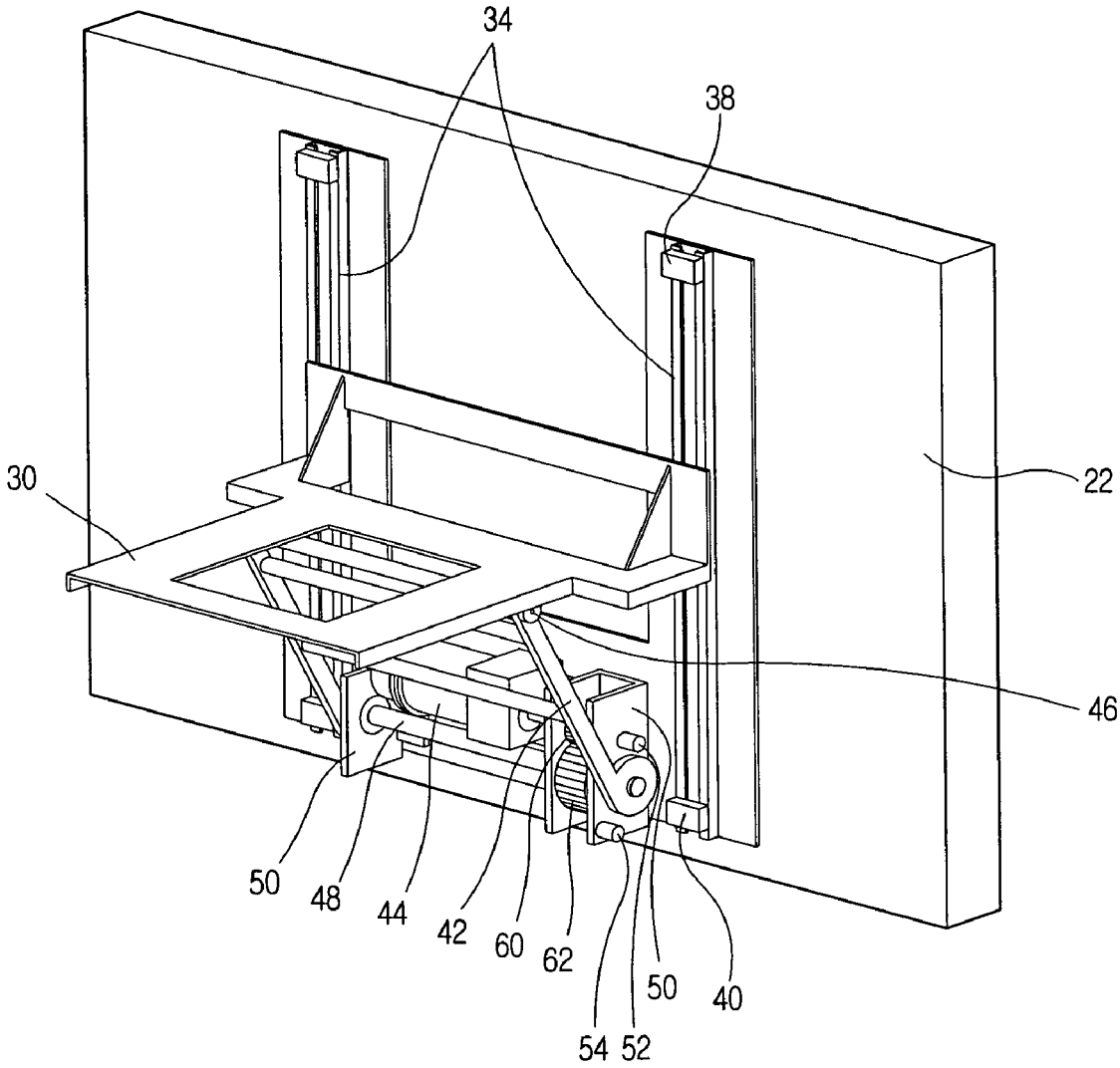
FIG. 5 is a perspective view of the basket lift device of the refrigerator in accordance with the present invention.

As shown in FIG. 5, the lift device includes a lift frame 30 disposed to be lifted/lowered in an up/down direction at the rear surface of the lower door 22, on which the basket 20 is provided thereon, a driving unit for lifting/lowering the lift frame 30 in the up/down direction, and a control unit for controlling lifting/lowering operation of the basket 20 by operating the driving unit 32 when the basket 20 is pulled out.

The lift frame 30 has a flat plate type on which the basket 20 can be mounted, and one side of the lift frame 30 is bent at a right angle and mounted at the rear surface of the lower door 22 in a manner of being moved in the up/down direction.

Herein, a pair of lift rails 34 are fixed at the rear surface of the lower door 22 in a vertical direction and the lift frame 30 is slidably mounted in the lift rail 34.

An upper stopper 38 and a lower stopper 40 are mounted at an upper and lower ends of the lift rail 34, respectively, to prevent the lift frame 30 from being released fro the lower door 22.

The driving unit 32 includes a driving arm 42 whose one end contacts with a lower surface of the lift frame 30 so as to be movable in an inward/outward direction and the other end thereof is rotatably mounted on a rear surface of the lower door 22, a driving motor 44 fixed at the rear surface of the lower door 22 and lifting/lowering the lift frame 30 by rotating the driving arm 42, and a driving force transfer unit for transferring a rotatory force generated from the driving motor 44 to the driving arm 42.

A roller 46 is mounted at one end of the driving arm 42 and rolls on a lower surface of the lift frame 30, and a hinge shaft 48 is mounted at the other end of the driving arm 42 and rotatably supported by a support frame 50 fixed on a rear surface of the lower door 22.

First and second stoppers 52 and 54 for limiting a rotation range of the driving arm 42 are formed at the side of the support frame 50.

The driving force transfer unit includes a driving gear 60 fixed at a rotational shaft of the driving motor 44 and disposed inside the support frame 50, and a passive gear 62 fixed at the hinge shaft 48 and geared with the driving gear 60.

If the driving arm 42 is formed as a pair such that it is disposed at both sides of the lift frame 30, the hinge shaft 48 extends and each driving arm 42 can be fixed at both end portions of the hinge shaft 48.

As for the driving force transfer unit, when the driving motor 44 is driven, the driving gear 60 is rotated, the passive gear 62 geared with the driving gear is accordingly rotated to rotate the hinge shaft 48, according to which the driving arm 42 is rotated.

The control unit includes an input unit for receiving a signal for lifting or lowering the basket from switches 66 and 68; a relay unit for applying a forward voltage and an inverse voltage to the driving motor according to the signal; a driving motor rotated in a forward/reverse direction (clockwise or counterclockwise); a first sensing unit for stopping the driving motor when the basket is in a maximum lifted state; and a second sensing unit for stopping the driving motor when the basket is in a maximum lowered state.

A control circuit of the control unit of the refrigerator in accordance with the present invention will now be described in detail with reference to FIGS. 6 and 7.

Figure 6:
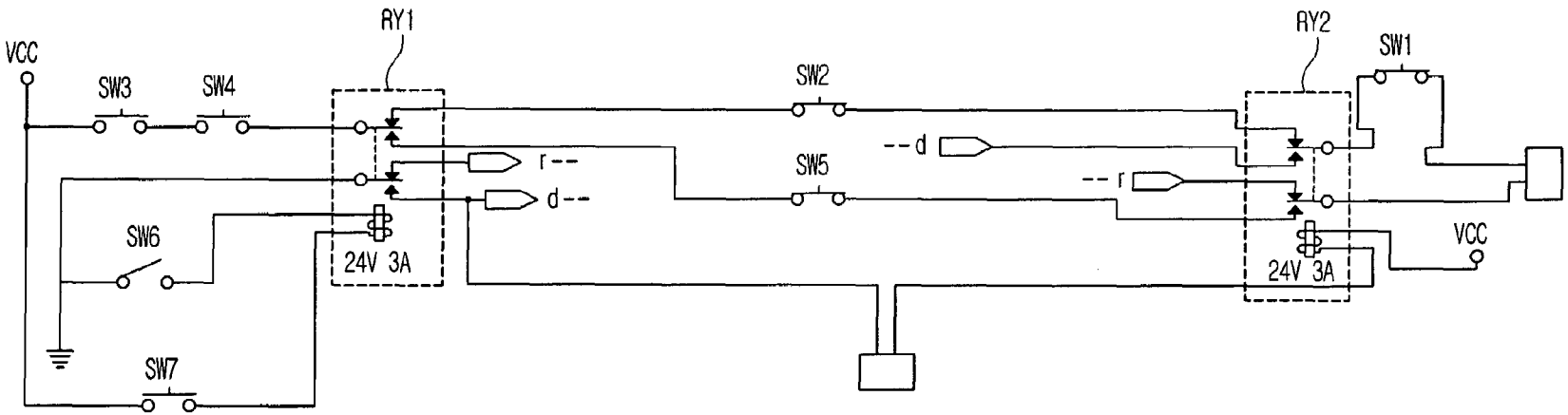
FIG. 6 illustrates a first embodiment of a control circuit of a control unit of the refrigerator in accordance with the present invention.

FIG. 6 illustrates a first embodiment of a control circuit of a control unit of the refrigerator in accordance with the present invention.

The input unit, the relay unit, and the first and second sensing units can be implemented in various ways, and preferably, the input unit is implemented as a switch SW6 and the relay unit is implemented as the first and second DPDP relays (RY1 and RY2). The DPDP relay unit includes two input terminals, four output terminals and two power input terminals, and the SPDP relay includes one input terminal, one output terminal and two power input terminals.

One end of the input unit SW6 is grounded and the other end is connected with the first power input of the first DPDP relay RY1.

The two input terminals of the first DPDP relay RY1 are connected with power source VCC and one end of the input unit, and the first and second power inputs, namely, two power input terminals of the first DPDP relay RY1, are connected with the other end of the input unit and the power source VCC, respectively.

The first output terminal of the first DPDP relay RY1 is connected with the first output terminal of the second DPDP relay RY2, the second output terminal of the first DPDP relay RY1 is connected with the fourth output terminal of the second DPDP relay RY2, the third output terminal of the first DPDP relay RY1 is connected with the third output terminal of the second DPDP relay RY2, the fourth output terminal of the first DPDP relay RY1 is connected with the second output terminal of the second DPDP relay RY2 and the second power input of the power input terminal of the second DPDP relay RY2. The two input terminals of the second DPDP relay RY2 are connected with the two terminals of the driving motor, respectively, and the first power input of the power input terminal of the second DPDP relay RY2 is connected with the power source VCC.

One end of the first sensing unit SW5 is connected with the second output terminal of the first DPDP relay, and the other end of the first sensing unit is connected with the fourth output terminal of the second DPDP relay.

One end of the second sensing unit SW2 is connected with the first output terminal of the first DPDP relay and the other end of the second sensing unit SW2 is connected with the first output terminal of the second DPDP relay.

The control unit can include a sensing unit for sensing an opened state of the upper door and one or more drawers, and an emergency switch for stopping the driving motor in case of emergency.

When an upper door open sensing switch for sensing an opened state of the upper door is included, the upper door open sensing switch is implemented as a single switch SW7 in the control circuit, which is, preferably, positioned between the second power input of the power input terminal and the power source VCC. Herein, the upper door open sensing switch is initially closed, and when the upper door is opened by at and less than a certain angle (namely, an angle at which the basket is interfered when lifted), the upper door open sensing switch is opened and the driving motor is not operated.

When one or more drawer open sensing switches for sensing an opened state of one or more drawers are included, the one or more drawer open sensing switches are, preferably, positioned between the power source VCC and the first input terminal of the first DPDP relay RY1 in the control circuit. On the drawing, there are shown two drawers. Accordingly, the draw open sensing switches are formed as the two switches SW3 and SW4. Herein, the one or more drawer open sensing switches are initially closed, and when one of the two draws is opened, a corresponding drawer open sensing switch is opened and power is not applied to the driving motor, so the driving motor is not driven.

In case that the emergency is included, the emergency switch is implemented as one switch SW1 in the control circuit, and preferably positioned between the first input terminal of the second DPDP relay RY2 and the driving motor. Herein, the emergency switch is initially closed, and when an emergency signal is inputted, the emergency switch is opened and thus the driving motor is not operated.

Figure 7:
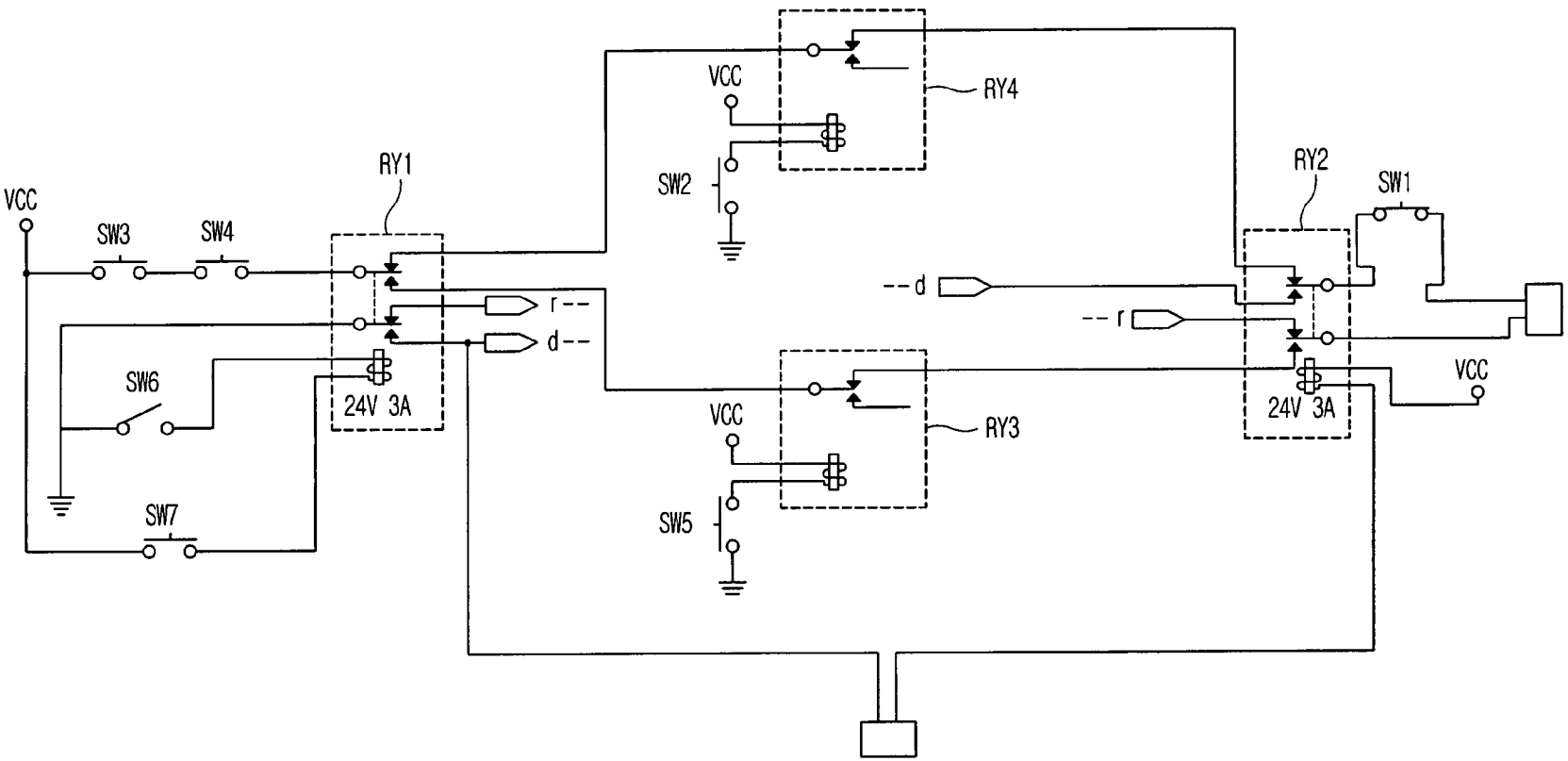
FIG. 7 illustrates a second embodiment of the control circuit of a control unit of the refrigerator in accordance with the present invention.

FIG. 7 illustrates a second embodiment of the control circuit of a control unit of the refrigerator in accordance with the present invention.

As shown in FIG. 7, the second embodiment of the control unit of the refrigerator in accordance with the present invention is the same as the first embodiment of the control unit except that the first sensing unit is implemented as a single SPDP relay RY3 and a single switch SW5 and the second sensing unit is implemented as a single SPDP relay RY4 and a single switch SW2.

Herein, the reason for implementing the first and second sensing units as the single SPDP relay and the single switch is to increase a permissible value of a current passing through the first and second sensing units by using the SPDP relay because the permissible current value of the switch is so small. Namely, it is to protect the first and second sensing units operating under a high current.

The control unit of the refrigerator can be variably implemented by satisfying the conditions of the first and second embodiments of the control circuit. Especially, the first and second sensing units can be implemented in various ways.

Various embodiments of the control unit of the refrigerator including variably implemented first and second sensing units will now be described in detail with reference to FIGS. 8 to 10.

The various embodiments of the control unit of the refrigerator in accordance with the present invention can be applied to the first and second embodiments of the control circuit of the control unit of the refrigerator, and the first embodiment of the control circuit of the control unit of the refrigerator in accordance with the present invention for the sake of explanation.

Figure 8:
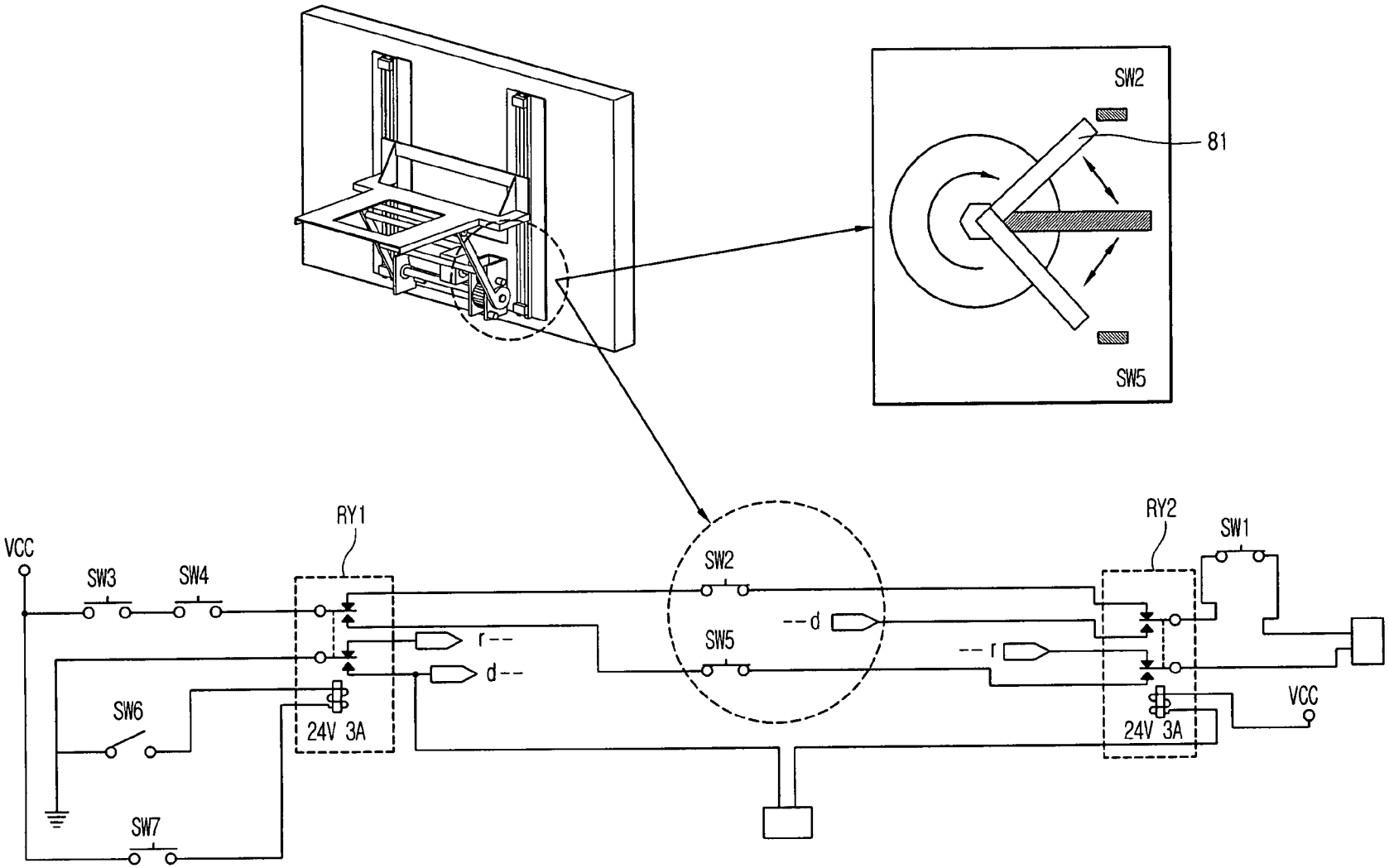
FIG. 8 illustrates a first embodiment of the control unit of the refrigerator in accordance with the present invention.

FIG. 8 illustrates a first embodiment of the control unit of the refrigerator in accordance with the present invention.

As shown in FIG. 8, the first embodiment of the control unit of the refrigerator in accordance with the present invention includes a rotation sensing bar connected with one end of the rotational shaft of the driving motor and integrally rotating with the rotational shaft, a first sensing unit installed at one side of a rotational trace of the rotation sensing bar; and a second sensing unit installed at the other side of the rotation trace of the rotation sensing bar.

The rotation sensing bar 81 is connected with the rotational shaft of the driving motor and integrally rotated with the rotational shaft of the driving motor. The first sensing unit SW2 is installed at an upper side of the rotation trace of the rotation sensing bar. The second sensing unit SW5 is installed at the other side of the rotation trace of the rotation sensing bar.

Preferably, the rotation sensing bar 81 points toward the rear surface of the lower door and the first sensing unit SW2 is installed below the second sensing unit SW5.

The first embodiment of the control unit of the refrigerator operates as follows.

When the driving motor is lifted and the basket reaches a maximum lifted position, the rotation sensing bar 81 is integrally rotated with the rotational shaft of the driving motor to reach a pre-set first position and the first sensing unit SW2 senses the rotation sensing bar 81. When the driving motor is lowered and the basket reaches a maximum lowered position, the rotation sensing bar 81 is integrally rotated with the rotational shaft of the driving motor to reach a pre-set second position and the first sensing unit SW2 detects the rotation sensing bar 81. When the first and second sensing units SW2 and SW5 sense the rotation sensing bar 81, the operation of the driving motor is stopped.

The control unit can include a sensing unit for sensing an opened state of the upper door and one or more drawers, and an emergency switch for stopping the driving motor in case of emergency, and in this case, the operation of the control unit is the same as described above.

Figure 9:
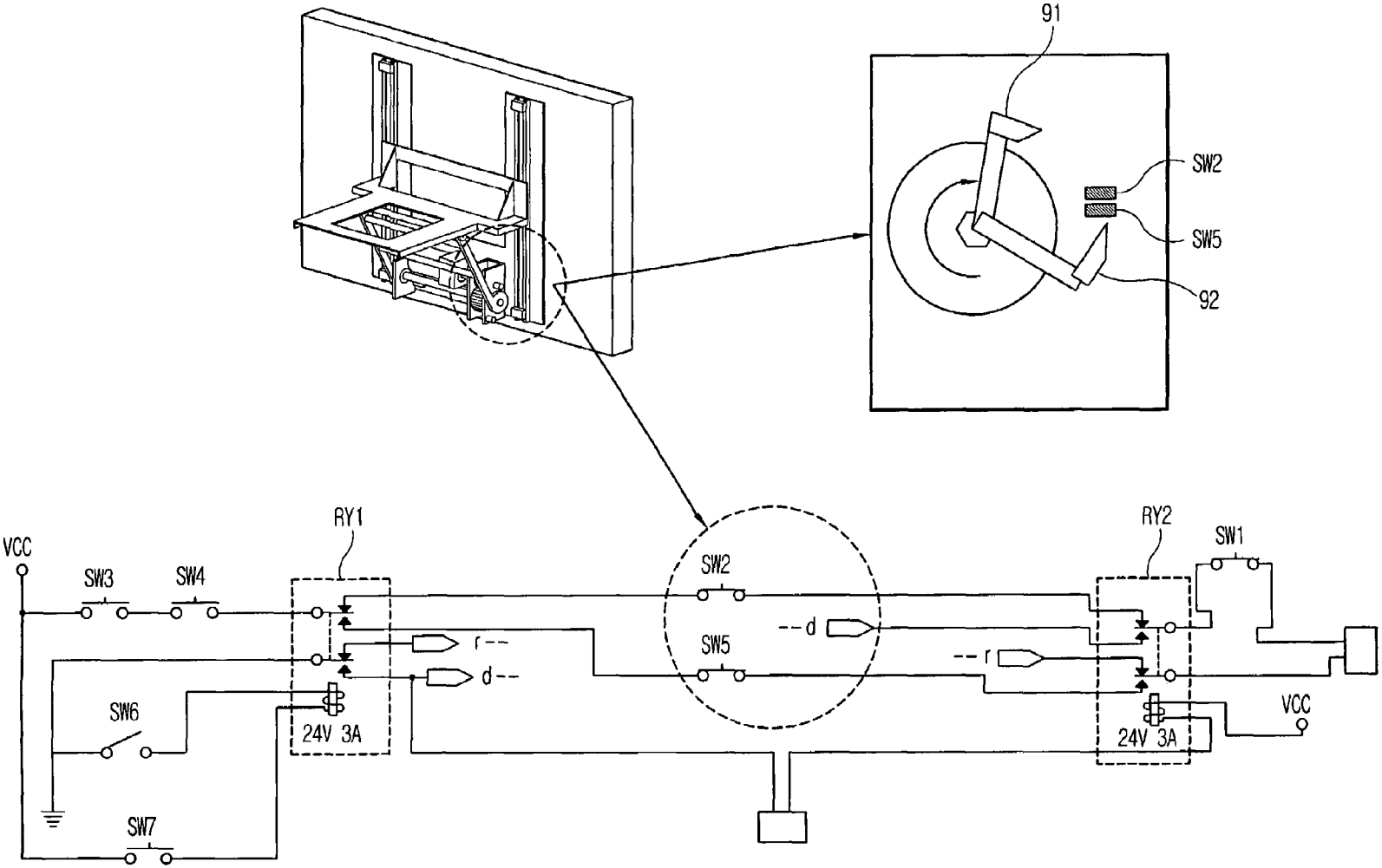
FIG. 9 illustrates a second embodiment of the control unit of the refrigerator in accordance with the present invention.

FIG. 9 illustrates a second embodiment of the control unit of the refrigerator in accordance with the present invention.

As shown in FIG. 9, the second embodiment of the control unit of the refrigerator in accordance with the present invention includes: a pair of sensing levers 91 and 92 connected with one end of the rotational shaft of the driving motor and installed spaced apart at a pre-set angle according to a rotation direction of the rotational shaft; and first and second sensing units SW2 and SW5 installed between the pair of sensing levers.

Each end portion of the pair of sensing levers 91 and 92 has a bent end portion bent in the direction of the first and second sensing units SW2 and SW5 so that it can easily contact with the first and second sensing units SW2 and SW5.

The first and second sensing units SW2 and SW5 are installed to face the opposite side and positioned to contact with the pair of sensing levers when the pair of sensing levers 91 and 92 are rotated.

The pair of sensing levers 91 and 92 face the rear surface of the lower door, and preferably, the second sensing unit SW2 is installed above the second sensing unit SW4 so that the first sensing unit SW2 can contact with the sensing lever 91 and the second sensing unit SW5 can contact with the sensing lever 92.

The operation of the second embodiment of the control unit is operated as follows.

When the driving motor is lifted and the basket reaches the maximum lifted position, the pair of sensing levers 91 and 92 are integrally rotated with the rotational shaft of the driving motor and the first sensing unit SW2 senses the sensing lever 91. Meanwhile, when the driving motor is lower and the basket reaches the maximum lowered portion, the pair of sensing levers 91 and 92 are integrally rotated with the rotational shaft of the driving motor and the second sensing unit SW4 senses the sensing lever 92. When the first and second sensing units SW2 and SW4 sense the sensing levers 91 and 92, the operation of the driving motor is stopped.

The second embodiment of the control unit in accordance with the present invention can include a sensing unit for sensing an opened state of the upper door and one or more drawers ad an emergency switch for stopping the driving motor in case of emergency. The operation of the second embodiment of the control unit of the refrigerator is the same as the first embodiment of the control unit.

Figure 10:
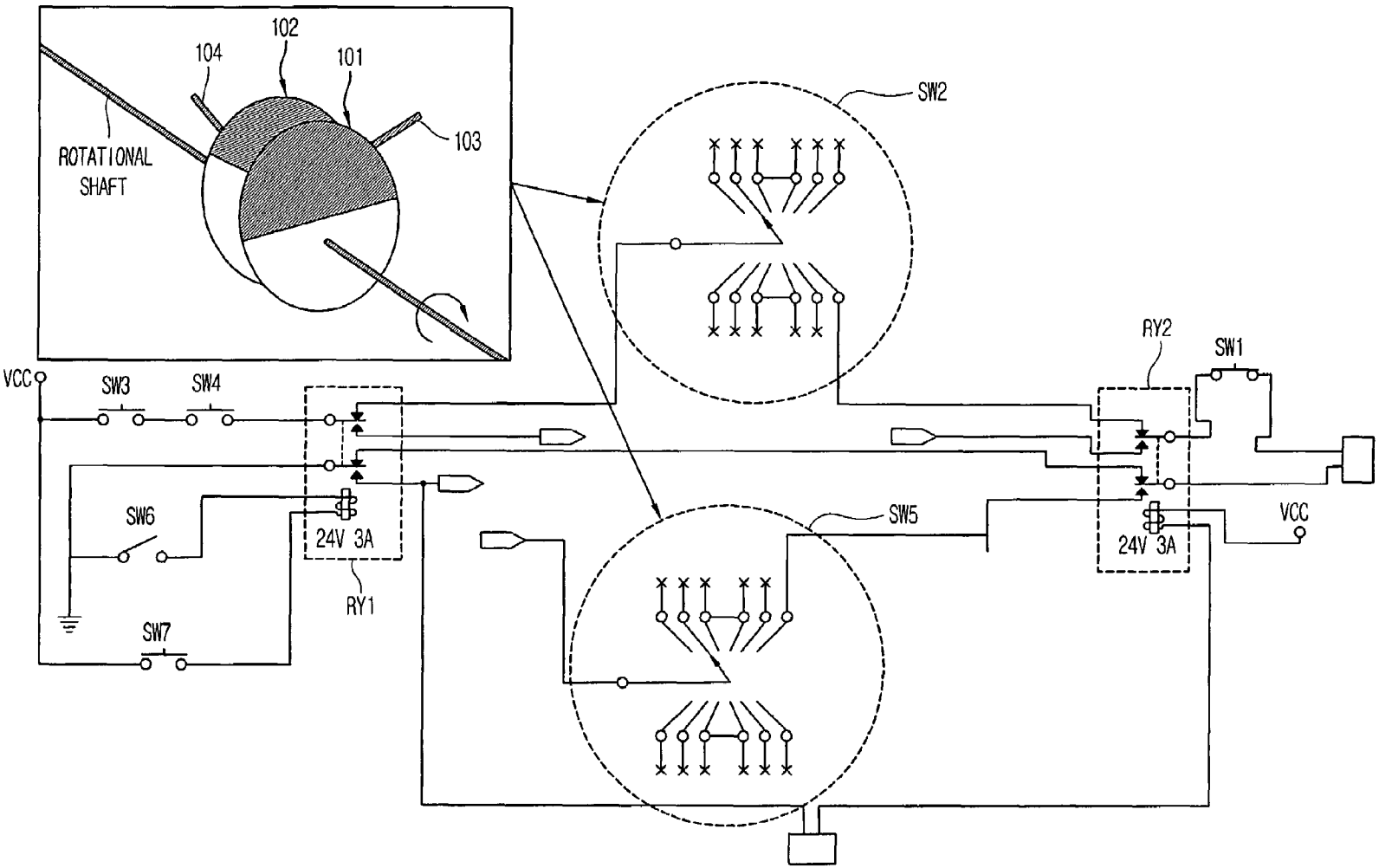
FIG. 10 illustrates a third embodiment of the control unit of the refrigerator in accordance with the present invention.

FIG. 10 illustrates a third embodiment of the control unit of the refrigerator in accordance with the present invention.

As shown in FIG. 10, the third embodiment of the control unit of the refrigerator in accordance with the present invention includes first and second circular platy switches which are connected with the rotational shaft of the driving motor and integrally rotate with the rotational shaft.

Namely, the third embodiment of the control unit of the refrigerator uses the first and second circular platy switches 101 and 102 as the first and second sensing units SW2 and SW5.

The circular platy switches include a conductive part and a non-conductive part. When a probe is positioned on the conductive part (shaded part), the circular platy switches are in a closed state and when the probe is positioned on the non-conductive part (non-shaded part), the circular platy switches are in an opened state. Namely, when the probes 103 and 104 are positioned on the conductive part of the first and second circular platy switches 101 and 102, the first and second circular platy switches 101 and 102 are closed.

An angle formed by the first and second circular platy switches is set to be different according to a distance between a position at which the basket is lifted to its maximum and a position at which the basket is lowered to its maximum, and preferably, it is 60°~90°.

The operation of the third embodiment of the control unit of the refrigerator is as follows.

When the driving motor is lifted and the basket reaches at the maximum lifted position, the probe 103 is positioned at the non-conductive part (non-shaded part) of the first circular platy switch, moving out of the conductive part (shaded part). Accordingly, the driving motor is stopped. Meanwhile, if the driving motor is lowered and the basket reaches the maximum lowered portion, the probe 104 is positioned at the non-conductive part (non-shared part), going out of the conductive part (shaded part) of the second circular platy switch. Accordingly, the driving motor is stopped.

The third embodiment of the control unit of the refrigerator can include a sensing unit for sensing an opened state of the upper door and one or more drawers and an emergency switch for stopping the driving motor in case of emergency, and the operation of the control unit of the refrigerator including them is the same as described above.

The refrigerator in accordance with the present invention operates as follows.

First, when a user opens the lower door, the driving unit is in a standby state for operating the basket. Namely, when the upper door is closed or when it is opened as much as or greater than a pre-set angle (at which the basket can be lifted without being interfered), the upper door open sensing switch SW7 which is initially in an open state, is closed. When one or more drawers are all closed, the one or more drawers open sensing switches are all maintained in the closed state. However, if at least one of the one or more drawers is opened, the drawer open sensing switch is opened and the driving motor is not operated.

When the user applies a signal to the input unit in order to lift the basket, the switch SW6 is closed, and power is applied to the DPDP relays RY1 and RY2, so that the driving motor is rotated in the forward direction by the forward voltage. At this time, when the basket is lifted to its maximum, the first sensing unit SW5 which is initially in a closed state is opened, so power is not applied to the driving motor and the driving motor is stopped. Accordingly, the basket is maintained at the maximum lifted state.

Next, when the user is closed or when a signal is applied to the input unit in order to lower the basket, the switch SW6 is opened, power is not applied to the DPDP relays RY1 and RY2, and the driving motor is rotated in the reverse direction by the reverse voltage. At this time, when the basket is lower to its maximum, the second sensing unit SW2 which is initially in the closed state is opened, power is not applied to the driving motor, and thus, the operation of the driving motor is stopped. Accordingly, the basket returns to its original position and is stopped.

If the user applies a signal to the emergency switch SW1 in case of emergency while the basket is being lifted or lowered, the emergency switch SW1 which is initially in a closed state is opened not to apply power to the driving motor, and thus, the operation of the driving motor is stopped.

As so far described, the refrigerator having the basket lift device in accordance with the present invention has many advantages.

That is, for example, when the basket disposed at the lower portion of the main body is opened, the basket is lifted. Accordingly, user convenience in putting food items in the basket and/or taking food items out of the basket can be enhanced. Specifically, each embodiment of the present invention has the supplementary effect as follows.

According to the first embodiment of the control unit of the refrigerator, the position of the basket of the basket of the refrigerator having the basket lift device is detected based on the rotational shaft of the driving motor of the basket lift device, so that even when the lift frame is fixed due to a specific reason (e.g., when it is caught by an adjacent device) and thus fail to be lowered, the driving motor can be stopped from its operation to prevent damage of the basket lift device.

According to the second embodiment of the control unit of the refrigerator, besides the effect such that of the control unit in the first embodiment, by installing the pair of sensing levers having a bent end portion, the first and second sensing units can precisely detect motion of the rotational shaft of the driving motor.

According to the third embodiment of the control unit of the refrigerator, besides the effect such that of the control unit in the first embodiment, by using the circular platy switch, the position of the first and second sensing units can be set according to the maximum lifted position of the basket and the maximum lowered position of the basket.

According to the first, second and third embodiments of the control unit of the basket lift device of the refrigerator in accordance with the present invention, the first and second units are used as a switch including the relay, so that the first and second sensing units can be prevented from being damaged due to a high current passing thereto.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator having a basket lift device comprising:

a main body having a refrigerating chamber;

a basket received in the refrigerating chamber;

a driving motor for lifting/lowering the basket; and a control unit for controlling the driving motor based on a motion of a rotational shaft of the driving motor, wherein the control unit includes an input unit for receiving a signal used for lifting or lowering the basket, and a relay unit for applying a forward voltage or an inverse voltage to the driving motor according to the signal.

2. The refrigerator of claim 1, wherein the relay unit is formed as a DPDP relay.

3. The refrigerator of claim 1, wherein the control unit comprises:

a first sensing unit for stopping the driving motor when the basket is lifted to its maximum; and a second sensing unit for stopping the driving motor when the basket is lowered to its maximum.

4. The refrigerator of claim 3, wherein the control unit comprises:

a rotation sensing bar connected at one end of a rotational shaft of the driving motor and rotated integrally with the rotational shaft, and the first sensing unit is a first switch installed at one side of a rotation locus of the rotation sensing bar and the second sensing unit is a second switch installed at the other side of the rotation locus of the rotation sensing bar.

5. The refrigerator of claim 4, wherein the first sensing unit further includes a relay connected with the first switch.

6. The refrigerator of claim 4, wherein the second sensing unit further includes a relay connected with the second switch.

7. The refrigerator of claim 3, wherein the control unit comprises:

sensing levers connected with one end of the rotational shaft of the driving motor and installed to be spaced apart at a pre-set certain angle according to a rotation direction of the rotational shaft, and the first sensing unit is a first switch positioned on a rotation locus of sensing levers and installed between the sensing levers, and the second sensing unit is a second switch positioned on the rotation locus of the sensing levers and installed between the sensing levers.

8. The refrigerator of claim 7, wherein an end portion of the sensing levers include an end portion bent in the direction of the first and second switches.

9. The refrigerator of claim 7, wherein the first and second switches are installed to point toward the opposite direction.

10. The refrigerator of claim 7, wherein the first sensing unit further includes a relay connected with the first switch.

11. The refrigerator of claim 7, wherein the second sensing unit further includes a relay connected with the second switch.

12. The refrigerator of claim 3, wherein the first sensing unit is a first circular platy switch connected with the rotational shaft of the driving motor and integrally rotated with the rotational shaft.

13. The refrigerator of claim 12, wherein the first sensing unit further includes a relay connected with the first circular platy switch.

14. The refrigerator of claim 3, wherein the second sensing unit is a second circular platy switch connected with the rotational shaft of the driving motor and integrally rotated with the rotational shaft.

15. The refrigerator of claim 14, wherein the second sensing unit further includes a relay connected with the second circular platy switch.

16. A refrigerator having a basket lift device comprising:

a main body having a refrigerating chamber;

an upper refrigerating chamber disposed at an upper portion of the main body and having an upper door;

a lower refrigerating chamber disposed at a lower portion of the main body and having a lower door opened in an forward/backward direction;

a basket disposed at the lower refrigerating chamber;

a driving motor for lifting/lowering the basket; and a control unit for controlling the driving motor based on a motion of a rotational shaft of the driving motor, wherein the control unit includes an input unit for receiving a signal used for lifting or lowering the basket, and a relay unit for applying a forward voltage or an inverse voltage to the driving motor according to the signal.

17. The refrigerator of claim 16, wherein the relay unit is formed as a DPDP relay.

18. The refrigerator of claim 17, wherein the control unit further comprises:

a first sensing unit for stopping the driving motor when the basket is lifted to its maximum; and a second sensing unit for stopping the driving motor when the basket is lowered to its maximum.

19. The refrigerator of claim 18, wherein the control unit comprises:

a rotation sensing bar connected at one end of a rotational shaft of the driving motor and rotated integrally with the rotational shaft, and the first sensing unit is a first switch installed at one side of a rotation locus of the rotation sensing bar and the second sensing unit is a second switch installed at the other side of the rotation locus of the rotation sensing bar.

20. The refrigerator of claim 19, wherein the first sensing unit further includes a relay connected with the first switch.

21. The refrigerator of claim 19, wherein the second sensing unit further includes a relay connected with the second switch.

22. The refrigerator of claim 18, wherein the control unit comprises:

sensing levers connected with one end of the rotational shaft of the driving motor and installed to be spaced apart at a pre-set certain angle according to a rotation direction of the rotational shaft, and the first sensing unit is a first switch positioned on a rotation locus of sensing levers and installed between the sensing levers, and the second sensing unit is a second switch positioned on the rotation locus of the sensing levers and installed between the sensing levers.

23. The refrigerator of claim 22, wherein an end portion of the sensing levers include an end portion bent in the direction of the first and second switches.

24. The refrigerator of claim 22, wherein the first and second switches are installed to point toward the opposite direction.

25. The refrigerator of claim 22, wherein the first sensing unit further includes a relay connected with the first switch.

26. The refrigerator of claim 22, wherein the second sensing unit further includes a relay connected with the second switch.

27. The refrigerator of claim 18, wherein the first sensing unit is a first circular platy switch connected with the rotational shaft of the driving motor and integrally rotated with the rotational shaft.

28. The refrigerator of claim 27, wherein the first sensing unit further includes a relay connected with the first circular platy switch.

29. The refrigerator of claim 18, wherein the second sensing unit is a second circular platy switch connected with the rotational shaft of the driving motor and integrally rotated with the rotational shaft.

30. The refrigerator of claim 29, wherein the second sensing unit further includes a relay connected with the second circular platy switch.

31. The refrigerator of claim 16, wherein when the upper door is opened at a pre-set angle or below the pre-set angle, the driving motor is not operated.

32. The refrigerator of claim 16, further comprising:

an emergency switch for stopping the operation of the driving motor in case of emergency.

33. The refrigerator of claim 16, further comprising:

one or more drawers positioned inside the lower refrigerating chamber and formed at an upper side of the basket.

34. The refrigerator of claim 33, wherein when the drawer is opened, the driving motor is not operated.

35. The refrigerator of claim 1, further comprising:

an emergency switch for stopping the operation of the driving motor in case of emergency.

36. The refrigerator of claim 1, further comprising:

one or more drawers positioned inside the lower refrigerating chamber and formed at an upper side of the basket.

37. The refrigerator of claim 35, wherein when the drawer is opened, the driving motor is not operated.

* * * * *